US007972198B2

(12) United States Patent
Noishiki et al.

(10) Patent No.: US 7,972,198 B2
(45) Date of Patent: Jul. 5, 2011

(54) GROOVE MACHINING METHOD BY MEANS OF WATER JET, HEAT EXCHANGER MEMBER, AND HEAT EXCHANGER

(75) Inventors: Koji Noishiki, Takasago (JP); Hiroyuki Ban, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 1019 days.

(21) Appl. No.: 11/680,985

(22) Filed: Mar. 1, 2007

(65) Prior Publication Data

US 2007/0234567 A1 Oct. 11, 2007

(30) Foreign Application Priority Data

Apr. 5, 2006 (JP) ..... 2006-104465

(51) Int. Cl.
*B24B 1/00* (2006.01)

(52) U.S. Cl. ..... 451/30; 451/29; 451/38; 451/54

(58) Field of Classification Search ..... 451/29, 451/30, 31, 38, 39, 54, 75, 80, 82, 84, 90; 239/1, 11

See application file for complete search history.

(56) References Cited

U.S. PATENT DOCUMENTS

| | | | | |
|---|---|---|---|---|
| 4,081,892 | A | 4/1978 | Mercer | |
| 5,704,824 | A * | 1/1998 | Hashish et al. | 451/36 |
| 5,767,621 | A | 6/1998 | De Haas et al. | |
| 5,833,516 | A | 11/1998 | De Haas et al. | |
| 6,921,518 | B2 | 7/2005 | Johnston | |
| 7,291,059 | B2 * | 11/2007 | Sugita et al. | 451/38 |
| 7,586,047 | B2 * | 9/2009 | Hayashi et al. | 174/266 |
| 2010/0003894 | A1 * | 1/2010 | Miller et al. | 451/5 |

FOREIGN PATENT DOCUMENTS

| | | |
|---|---|---|
| CN | 1079072 A | 12/1993 |
| FR | 2 860 226 | 4/2005 |
| JP | 2004-58206 | 2/2004 |

* cited by examiner

*Primary Examiner* — Eileen P. Morgan
(74) *Attorney, Agent, or Firm* — Oblon, Spivak, McClelland, Maier & Neustadt, L.L.P.

(57) ABSTRACT

There is provided a groove machining method by means of water jet which machines grooves by means of a water jet device including injection nozzles for injecting a water jet on a face to be machined of a member to be machined, including a step of disposing protection members which are more resistive against an injection power of the water jet than the member to be machined so as to cover a portion which is a part of the face to be machined, and on which grooves are not to be formed in order to form ends of the machined grooves in a travel direction of the injection nozzles inside an outline of the face to be machined, and a step of moving the nozzles across the protection members and the face to be machined while injecting the water jet at a predetermined injection power from the injection nozzles.

6 Claims, 5 Drawing Sheets

GROOVE MACHINING METHOD BY MEANS OF WATER JET, HEAT EXCHANGER MEMBER, AND HEAT EXCHANGER

BACKGROUND OF THE INVENTION

1. Field of the Invention

The present invention relates to a groove machining method, which forms narrow grooves on a face to be machined of a member to be machined such as a metal plate by injecting a water jet from injection nozzles of a water jet device, and also relates to a heat exchanger member and a heat exchanger.

2. Description of the Related Art

Narrow grooves have conventionally been formed on a surface of a metal plate or the like by means of various machining methods such as "groove machining method by chemical etching", "groove machining method by water jet", and "groove machining method by micro blasting". A description will now be given of an overview relating to the conventional examples of the groove machining method which forms narrow grooves on a surface of a metal plate or the like. A groove machining method according to the first conventional example is a machining method which employs a photographic printing technology, protects a portion which is not to be machined with resin or the like, and then forms passages (grooves) by means of etchant.

"Groove machining method by means of water jet, and manufacture of die for forming honeycomb structure" relating to the second conventional example is a method for machining grooves with a bottom on a surface of a workpiece. More particularly, it is a method for manufacturing a die for forming a honeycomb structure, by moving a position for applying an injection to a workpiece along positions where grooves are formed at a relative speed equal to or more than 200 mm/minute, having supply holes for supplying a material, and slit grooves which communicate with the supply hole, are arranged as a grid, and form a material into a honeycomb shape, where the respective slit grooves have a depth ten or more times as long as the width (refer to Japanese Patent Laid-Open No. 2004-58206, for example).

"Chemical reactor with heat exchanger" relating to the third conventional example describes machining of passages (grooves) of a heat exchanger. Namely, it describes that "the heat exchanger of choice is one formed from a plurality of plates superposed and diffusion bonded to form a stack of plates, wherein each plate is selectively configured according to the desired pattern of channels by a chemical or mechanical treatment to remove a surface material e.g. by chemical etching, hydraulic milling, or cutting by means of water jet to a desired depth" (refer to U.S. Pat. No. 6,921,518, for example).

It is considered that the groove machining method according to the first conventional example is excellent in enabling to machine passages (grooves) in a very complex shape. However, the technology according to the first conventional example cannot form deep passages (grooves), and can form only shallow passages (grooves) whose aspect ratio (aspect ratio of the groove) is in a range of 1 to 0.5, for example. Moreover, since the etchant (corrosive liquid) is used, there poses such a problem that it is difficult to etch in metals such as aluminum whose corrosion reaction speed is high. Further, it is also necessary to dispose waste liquid, and there thus poses such an economical problem that the capital investment relating to the facility increases, resulting in a high cost.

The groove machining method according to the second conventional example manufactures a die for forming a honeycomb structure having grooves whose width and depth are respectively 0.1 mm and 2.5 mm by repeating injection of a water jet at 240 mm/minute 240 times. In other words, the groove machining method according to the second conventional example has such a problem that a very long period is required for machining, which is not practical, and, also, the movement of the injection nozzle should be repeated 240 times for the same point while injecting the water jet, resulting in difficult management of machining precision. Moreover, no description is given of machining grooves in a very complex shape.

U.S. Pat. No. 6,921,518 relating to the third conventional example includes a description that a surface material is removed down to a desired depth with chemical etching, hydraulic milling, or cutting by means of water jet.

However, the technology according to the third conventional example intends to manufacture a heat exchanger, simply describes the general methods which are considered to be able to form passages upon a thin plate, and does not describes any specific methods.

When grooves are machined on a plate, the surface area per volume increases, and if the plate is used for a heat exchanger and a reactor, a heat transfer area increases, an area contributing to a reaction increases, and the performance of the heat exchanger and the reactor thus increases. The increase of the surface area per volume by means of machining deep grooves on a plate is extremely efficient for increasing the performance of heat exchangers and reactors. Moreover, the machining of deep grooves on a plate reduces the number of plates to be machined for acquiring the same surface area, and, thus, leads to a reduction of a period required for switching the plates, a reduction of the period for the machining, and a reduction of the machining cost.

If an end of a groove is machined by means of the water jet inside an outline of a face to be machined of a member to be machined, the travel (start, stop, and velocity) and the injection (start, stop, and injection power) of an injection nozzle have conventionally been controlled. Therefore, it is difficult to maintain equal groove machining conditions at the beginning of, in the middle of, and at the end of the machining of a groove, and it is thus extremely difficult to maintain constant depth and width of the groove at a start end and a terminal end of the groove. For example, if one tries to stop the injection as soon as the travel of the injection nozzle stops, a residual pressure inside the injection nozzle does not allow to stop the injection immediately, and there poses such a problem that the water jet penetrates a member to be machined. Moreover, if the injection is gradually weakened so that the injection of the water jet is stopped (the residual pressure becomes zero) when the injection nozzle stops traveling, or the injection is caused to start as soon as the injection nozzle starts traveling, the depth and the width of a groove gradually increase or decrease, and there thus poses such a problem that constant depth and width cannot be achieved.

Due to the above various problems, it is difficult to employ the water jet for machining a groove in a complex shape, which requires control of frequent starts and stops of the travel and injection of an injection nozzle. Moreover, if a fluid is caused to flow a groove (passage) whose depth or width is not constant, the groove is blocked, or an abnormal pressure loss occurs due to a change in the cross section of the groove. As a result, since it is difficult to apply a water jet device to groove machining on a heat exchanger member (heat exchange core) where ends of grooves are formed inside outlines of faces to be machined, and the depth and the width of the grooves should be constant, it is necessary to mainly employ cutting or etching for machining the grooves on the heat exchanger member (heat exchange core).

However, since the machining of grooves by means of etching have above various problems, and a groove whose aspect ratio is equal to or more than 1, whose shape is complex and whose depth is constant cannot be machined in a short period, there has been a strong need for establishing a groove machining method which enables such a groove. With respect to the facility cost (elimination of a facility to dispose etchant) and the function to machine deep grooves, it is preferable to establish a method for machining such grooves by means of the water jet.

It is an object of the present invention to provide a groove machining method by means of a water jet which machines in a short period deep grooves whose aspect ratio is equal to or more than 1, whose shape is complex, and whose depth is constant. It is another object of the present invention to provide a heat exchanger member which has a wide surface area per volume. It is still another object of the present invention to provide a heat exchanger of high heat transfer performance by using this heat exchanger member.

SUMMARY OF THE INVENTION

In order to achieve the above objects, the present invention provides a groove machining method by means of water jet which machines a groove by means of a water jet device including an injection nozzle for injecting a water jet on a face to be machined of a member to be machined, including a step of disposing protection members which are more resistive against an injection power of the water jet than the member to be machined so as to cover a portion which is a part of the surface of the face to be machined, and on which the grooves are not to be formed, and a step of moving the injection nozzle across the protection members and the face to be machined while injecting the water jet at a predetermined injection power from the injection nozzle.

The groove machining method by means of water jet according to the present invention is preferably applied to a case where ends of grooves are formed inside outlines of the face to be machined. Even in this case, it is possible to machine ends of grooves whose depth and width are approximately constant by means of the water jet.

In the groove machining method by means of water jet, the water jet may be injected from multiple provided injection nozzles. With this configuration, multiple grooves can be machined by a travel of the injection nozzles once, which contributes to a reduction of the man-hour for machining the grooves on the face to be machined. Moreover, though the multiple injection nozzles simultaneously move the same distance, it is possible to machine multiple grooves different in length by configuring the shape of protection members.

In the groove machining method by means of water jet, the member to be machined may be made of metal. In this case, abrasives are preferably mixed with the water jet. Since the water jet mixed with the abrasives is injected from the injection nozzle, it is possible to machine the member to be machined made of metal in a short period.

A heat exchanger member according to the present invention is manufactured by the groove machining method by means of water jet where the member to be machined is made of metal, abrasives are mixed with the water jet, and the aspect ratio of grooves formed by the groove machining method is equal to or more than 1.

The aspect ratio of grooves formed by the etching is generally 1 to 0.5, and grooves with an aspect ratio equal to or more than 1 are formed by machining. However, according to the heat exchanger member according to the present invention, it is possible to obtain a heat exchanger member on which grooves whose aspect ratio is equal to more than 1, and which have a complex shape including bends and the like are machined by means of the water jet.

In the heat exchanger member, the member to be machined is a plate-shape member, and the grooves can be machined on either of or both of front and rear faces as the face to be machined.

A heat exchanger can be manufactured by stacking the multiple heat exchanger members in the thickness direction of the plate members, or by alternately stacking the multiple heat exchanger members and multiple plate members in the thickness direction.

In the heat exchanger, the members to be stacked are partially or entirely joined at portions which do not include the machined grooves, and remain at an outer periphery of the face to be machined by brazing, diffusion bonding, or welding.

With the heat exchanger member and the heat exchanger according to the present invention, since the grooves whose aspect ratio is equal to or more than 1, and which have a complex shape including bends and the like are machined on the face to be machined of the plate members, which are the members to be machined, and the heat transfer area of the heat exchanger member is wide, a heat exchanger of high heat transfer performance can be obtained using the heat exchanger members.

BRIEF DESCRIPTION OF THE DRAWINGS

FIGS. 8A to 8C relate to the embodiment of the present invention, in which:

FIG. 8A describes a configuration of a grooved plate for a heat exchanger produced without employing the groove machining method according to the present invention;

FIG. 8B describes a configuration of a grooved plate for a heat exchanger produced according to the groove machining method according to the present invention; and FIG. 8C describes a configuration of a heat exchange core produced using the grooved plates.

DETAILED DESCRIPTION OF THE PREFERRED EMBODIMENTS

With sequential reference to accompanying drawings, a description will now be given of a groove machining method by means of water jet according to the present invention applied to an example where grooves are machined on a surface, which is a face to be machined, of a thin plate, which is a member to be machined, to manufacture a grooved plate for a heat exchange core (heat exchanger member) which is a component of a heat exchanger.

The grooved plates for the heat exchange core can be produced by machining multiple grooves on a surface of a thin plate, which has a rectangular plane, and is a member to be machined, by means of the groove machining method according to the present invention either with a water jet device including one injection nozzle or with a water jet device including multiple injection nozzles. With sequential reference to FIG. 1, 3 to 7, a description will now be given of first to fifth groove machining steps for machining grooves shown in FIG. 2 whose pitch is 1.6 mm, whose depth is 2 mm, whose width is 1 mm, and whose aspect ratio is 2 to manufacture a grooved plate for a model heat exchanger shown in FIG. 1.

Figure 3:
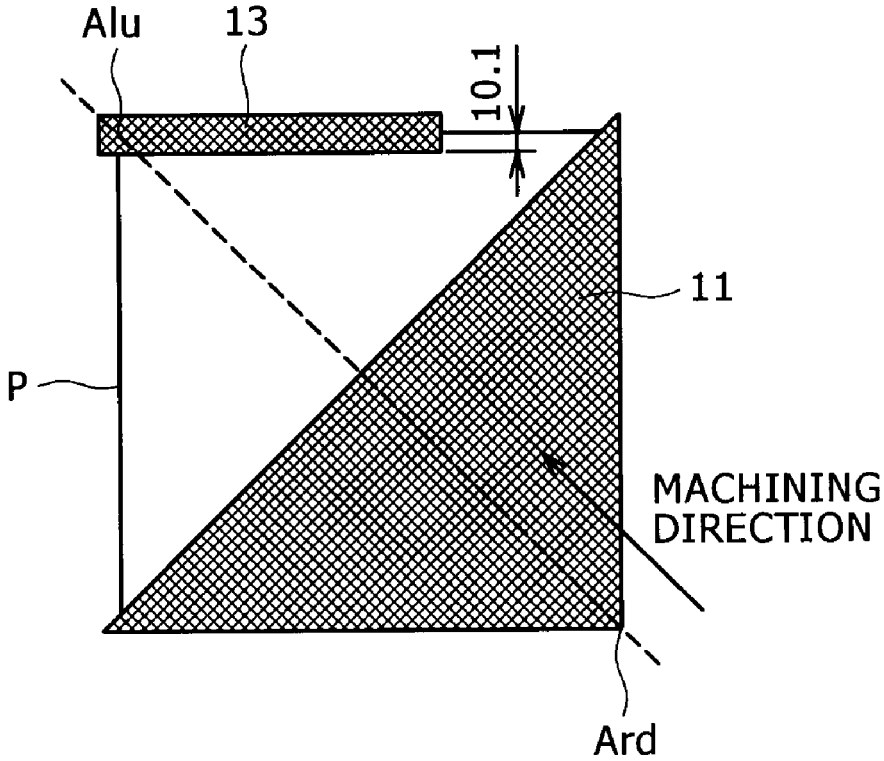
FIG. 3 describes a first groove machining step of machining grooves on a face to be machined of a thin plate to produce a grooved plate for a heat exchange core according to the embodiment of the present invention.

In the first groove machining step for machining a groove on a face to be machined of a thin plate P thereby manufacturing the grooved plate for the heat exchange core, portions in which the grooves are not to be formed on a surface of the thin plate P made of aluminum with a dimension of one edge of 200 mm are covered by placing protection members (referred to as protection plates) in a shape described later, and then an injection nozzle is moved in a predetermined direction while injecting a water jet as shown in FIG. 3.

More specifically, a right-angled corner of a first protection plate 11 in a right triangle shape having edges of 205 mm on both sides of the right angle is aligned to a lower right corner $A_{rd}$ where the bottom edge and the right edge of the thin plate P intersect at right angle. Thus, the first protection plate 11 covers a half of the area of the thin plate P on the right and bottom sides where the grooves are not to be formed. Moreover, a third protection plate 13 which is 15 mm in width, and is 150 mm in length, is disposed at a left edge portion of the top edge where the grooves are not to be formed, on a top face of the thin plate P in order to form an end of the machined groove in the travel direction of the injection nozzle inside the outline of the surface of the thin plate P.

After these protection plates 11, 13 are disposed, the injection nozzle is moved along the diagonal line extending from the lower right corner $A_{rd}$ of the thin plate P obliquely leftward and upward in FIG. 3, namely to the upper left corner $A_{lu}$, where the top edge and the left edge of the thin plate P intersect at right angle, while injecting the water jet. Then, one groove 1 which runs obliquely leftward and upward, and serves as a start end and a terminal end of the grooves, is machined on the diagonal line of the thin plate P, and on a portion which is not covered with the first and third protection plates 11, 13.

A material, which is machined at a slower speed by means of the water jet (machined to a shallower depth) than the thin plate as the member to be machined, namely, which is more resistive against the injection power of the water jet, can be used as a material of the protection plates. In this case, since the thin plate P is aluminum, stainless steel plates are employed as the protection plates.

However, since the protection plates are disposed on the face to be grooved of the thin plate P in order to prevent the machined face of the thin plate P to be grooved from being damaged, the material is not necessarily a hard material.

The material may be an impact-absorbing resin material such as a photo resist which is a polymeric material used in etching and blasting, for example, and is thus not specifically limited to a hard material. Moreover, grooving conditions, namely, the pressure of the water jet device is 1500 kgf/cm$^2$, and the travel speed of the injection nozzle is 1000 mm/minute, for example. It should be noted that abrasives including garnet whose average diameter is 180 μm, for example, are mixed with the water jet.

Figure 4:
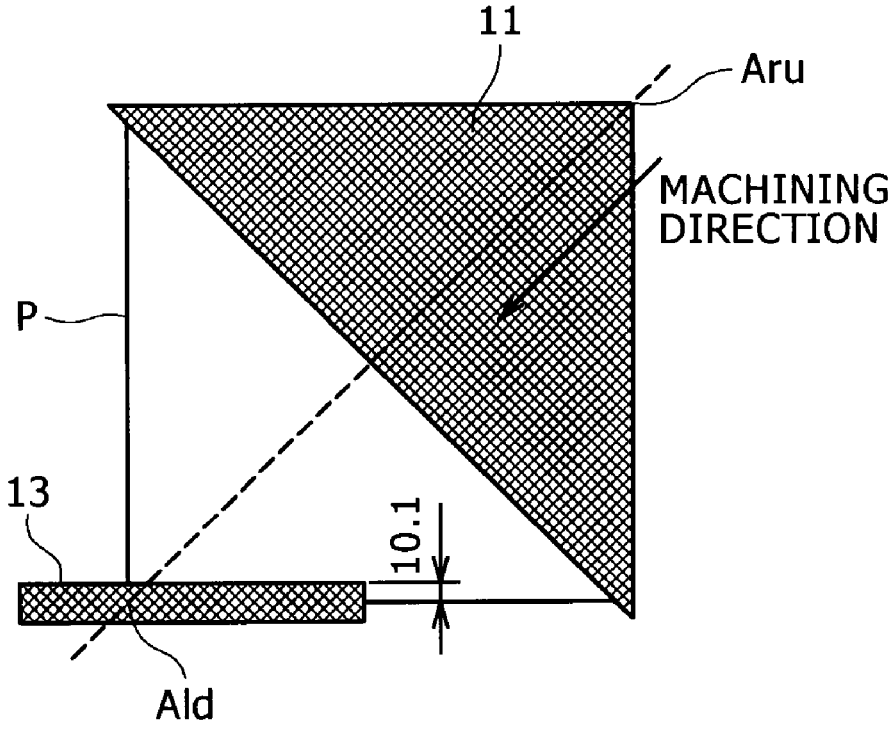
FIG. 4 describes a second groove machining step of machining the grooves on the face to be machined of the thin plate to produce the grooved plate for the heat exchange core according to the embodiment of the present invention.

In the second groove machining step for machining a groove on the face to be machined of the thin plate P to produce the grooved plate, the right-angled corner of the first protection plate 11 is aligned to the upper right corner $A_{ru}$ where the top edge and the right edge of the thin plate P intersect at right angle. Thus, the first protection plate 11 covers a half of the area of the thin plate P on the right and top sides where the grooves are not to be formed as shown in FIG. 4. Moreover, the third protection plate 13 is disposed at a left edge portion of the bottom edge where the grooves are not to be formed, on the top face of the thin plate P in order to form an end of the machined groove in the travel direction of the injection nozzle inside the outline of the surface of the thin plate P. After these protection plates 11, 13 are disposed, the injection nozzle is moved along the diagonal line extending from the upper right corner $A_{ru}$ of the thin plate P obliquely leftward and downward in FIG. 4, namely to the lower left corner $A_{ld}$, where the bottom edge and the left edge of the thin plate P intersect at right angle, while injecting the water jet. Then, one groove 2 which runs obliquely leftward and downward, and serves as a start end and a terminal end of the grooves, is machined on the diagonal line of the thin plate P, and on a portion which is not covered with the first and third protection plates 11, 13.

Figure 5:
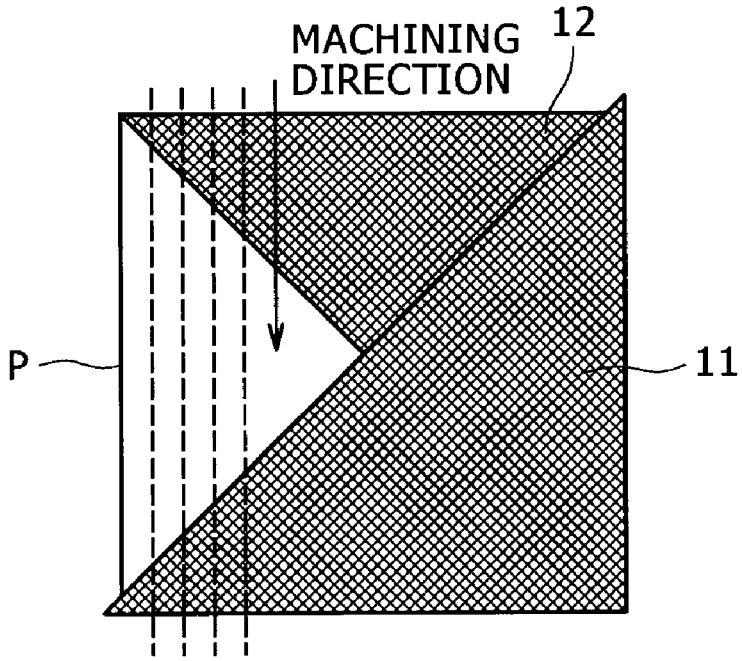
FIG. 5 describes a third groove machining step of machining the grooves on the face to be machined of the thin plate to produce the grooved plate for the heat exchange core according to the embodiment of the present invention.

In the third groove machining step for machining grooves on the face to be machined of the thin plate P to produce the grooved plate, the right-angled corner of the first protection plate 11 is aligned to the lower right corner $A_{rd}$ of the thin plate P so as to cover a half of the area of the thin plate P on the right and bottom sides as shown in FIG. 5. Moreover, a right-angled corner of a second protection plate 12 in a right triangle shape having edges of 150 mm on both sides of the right angle is aligned to the bottom edge of the first protection plate 11 so as to cover a quarter of the area of the thin plate P on the upper side including the top edge of the thin plate P. Then, multiple parallel grooves are formed on a left right triangle which occupies a quarter of the area of the thin plate P. The left right triangle is formed by the left edge of the thin plate P, the line passing one end of the left edge and the center of the thin plate P, and the line passing another end of the left edge and the center of the thin plate P.

Namely, the injection nozzle is reciprocated downward from the top side in FIG. 5 in parallel with the left edge of the thin plate P while the water jet is being injected to machine straight grooves 3 which intersect the groove 1 oriented obliquely leftward and upward and the groove 2 oriented obliquely leftward and downward at an angle of 45 degrees, and start and terminate at the intersections. Though the grooves machined in the third groove machining step are straight grooves 3, the grooves may be waved grooves.

Figure 6:
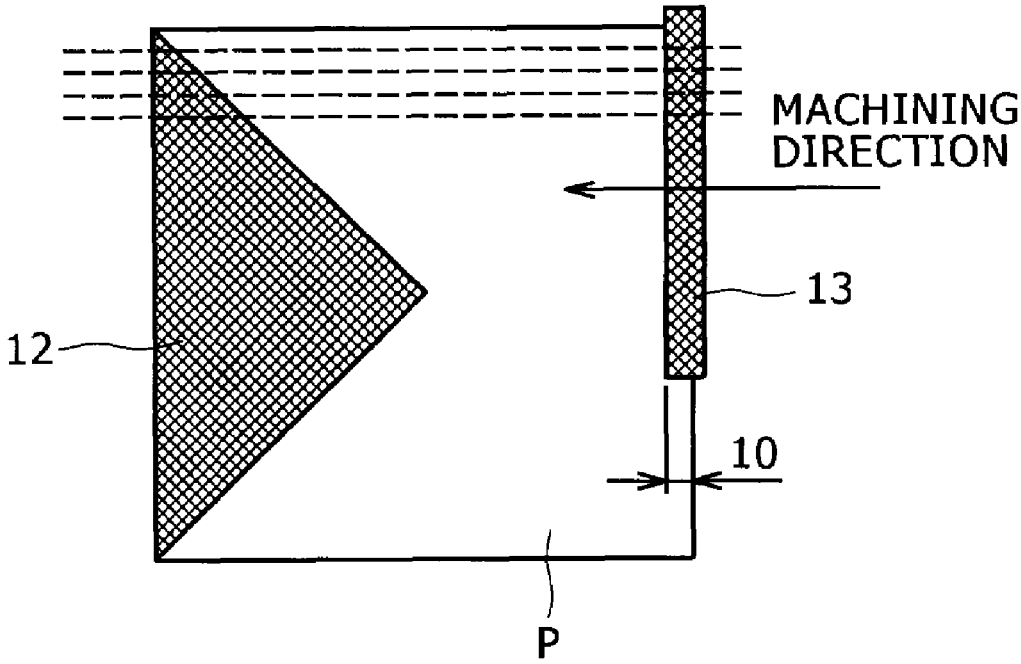
FIG. 6 describes a fourth groove machining step of machining the grooves on the face to be machined of the thin plate to produce the grooved plate for the heat exchange core according to the embodiment of the present invention.

In the fourth groove machining step for machining grooves on the face to be machined of the thin plate P to produce the grooved plate, the second protection plate 12 is disposed on a quarter of the area on the left side including the left edge and the center of the thin plate P to cover the machined area of the straight grooves 3 as shown in FIG. 6. Moreover, the third protection plate 13 is disposed at a top edge portion of the right edge where the grooves are not to be formed, on the top face of the thin plate P in order to form ends of the machined grooves in the travel direction of the injection nozzle inside the outline of the surface of the thin plate P.

Then, after these protection plates 12, 13 are disposed, multiple waved grooves are machined in a trapezoidal area which is not covered by the protection plates 12, 13, and which is between the top edge of the thin plate P and a horizontal line which is parallel to the top edge and passes the center. Namely, the injection nozzle is reciprocated meandering in parallel with the top edge of the thin plate P from the right side to the left side in FIG. 6 while the water jet is being injected to machine waved grooves 4 which intersect the groove 1 oriented obliquely leftward and upward, and start and terminate at the intersections. Though the grooves machined in the fourth groove machining step are waved grooves 4, the grooves may be straight grooves.

Figure 7:
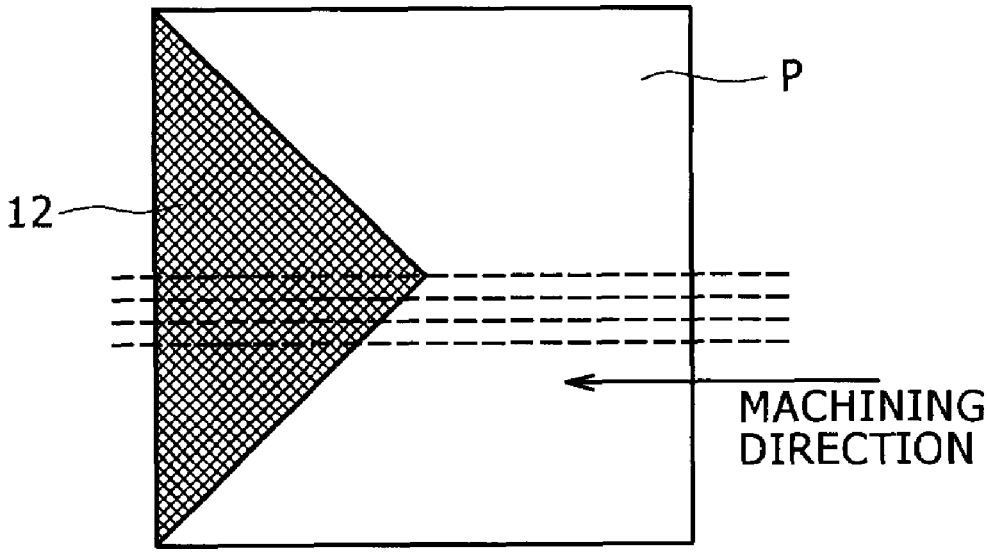
FIG. 7 describes a fifth groove machining step of machining the grooves on the face to be machined of the thin plate to produce the grooved plate for the heat exchange core according to the embodiment of the present invention.

In the fifth groove machining step for machining the grooves on the face to be machined of the thin plate P to produce the grooved plate, the third protection plate 13 is removed while the second protection plate 12 remains disposed in the quarter area on the left side including the left edge and the center of the thin plate P. Thereafter, the injection nozzle is reciprocated meandering in parallel with the top edge of the thin plate P from the right side to the left side in FIG. 7 while the water jet is being injected to machine multiple waved grooves in a trapezoidal area which is not covered with the second protection plate 12 and which is between the bottom edge of the thin plate P and a horizontal line parallel with the bottom edge and passes the center, as shown in FIG. 7. Thus, waved grooves 5 are machined so as to communicate with the outside of the thin plate P on one end, to intersect the groove 2 oriented obliquely leftward and downward on the other end, and to terminate at the intersections. Though the grooves machined in the fifth groove machining step are waved grooves as the grooves machined in the fourth groove machining step, the grooves may be straight grooves.

As the above description relating to the groove machining method by means of water jet according to the present invention clearly shows, the groove machining method by means of water jet according to the present invention properly disposes the various protection plates different in shape on the surface of the thin plate P, starts injecting the water jet when the injection nozzle is not above the face to be machined (is above the protection plate, for example), and moves the injection nozzle upon an initial injection power being reached. Then, after the injection nozzle reaches another protection plate, and comes out of the face to be machined, the travel of the injection nozzle is stopped, and the injection of the water jet is stopped. In this way, it is possible to produce the grooved plate shown in FIG. 1 by sequentially going through the first to fifth groove machining steps.

Therefore, it is not necessary for the groove machining method by means of water jet according to the present invention to start the injection as soon as the injection nozzle starts traveling, or to stop the injection as soon as the injection nozzle stops traveling, unlike the conventional groove machining by means of water jet. Moreover, since it is not necessary to gradually weaken the injection so that the injection of the water jet is stopped (the residual pressure becomes zero) when the injection nozzle stops traveling, the depth and width of the groove do not gradually increase or decrease. Thus, according to the groove machining method by means of water jet according to the present invention, since the injection nozzle is simply moved while the water jet is being injected at the initial injection power, there is provided an excellent effect that deep grooves with a complex structure and an approximately uniform depth are machined in a short period without complex control.

Figure 1:
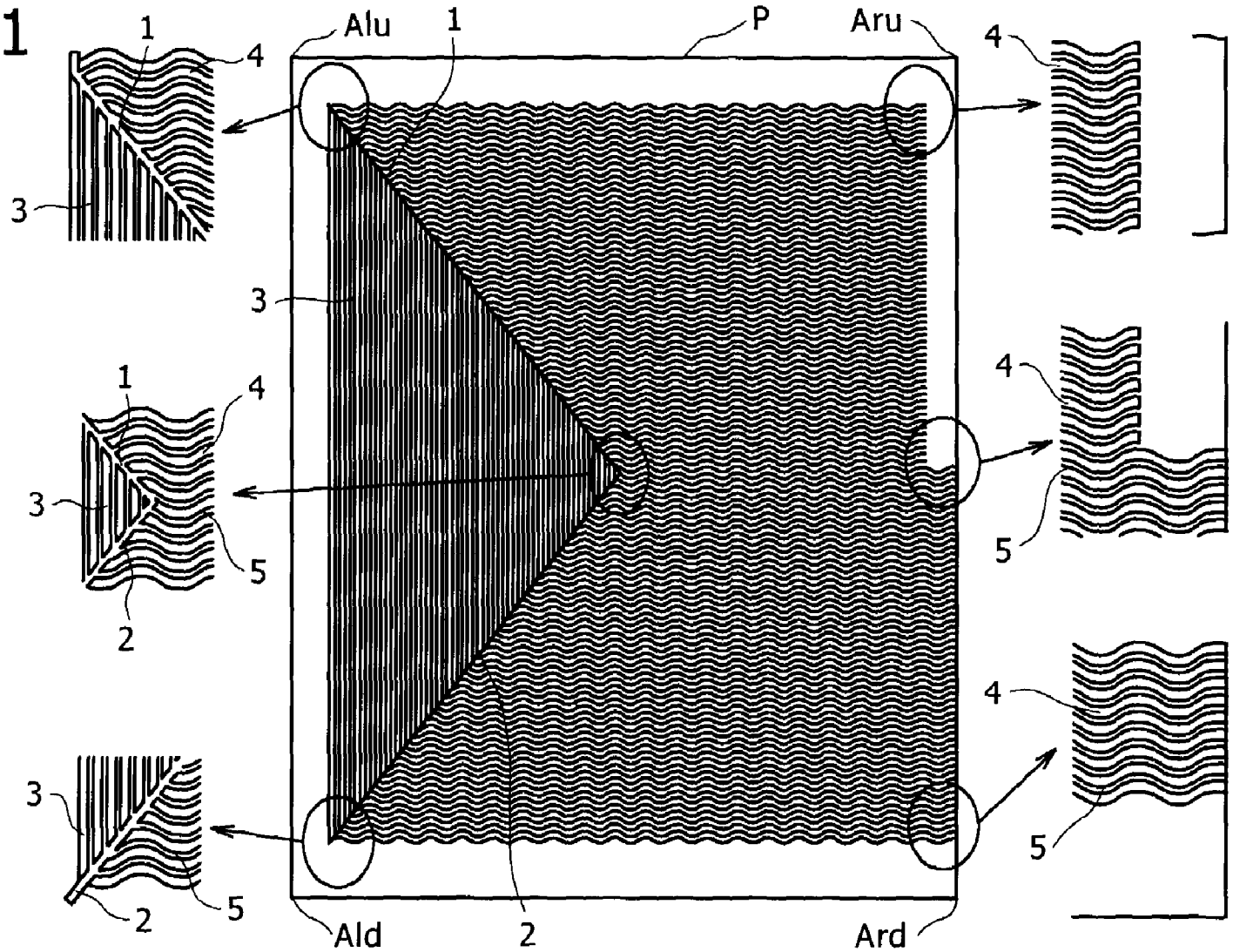
FIG. 1 describes groove machining according to an embodiment of the present invention.
Figure 2:
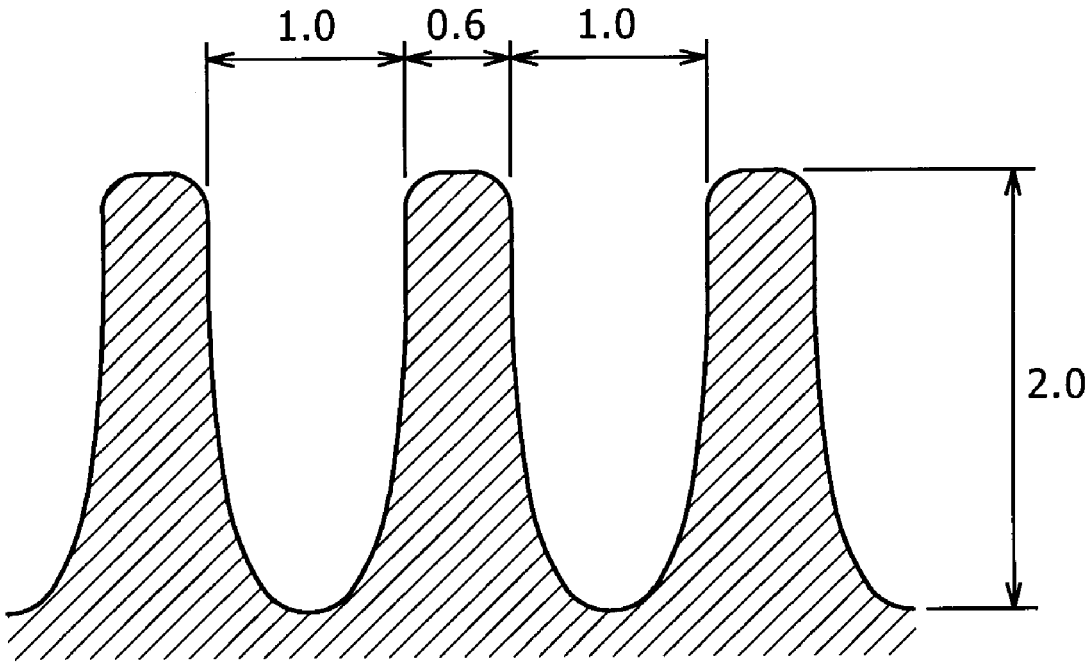
FIG. 2 describes a cross sectional configuration of grooves according to the embodiment of the present invention.

In other words, due to the effects of the respective protection plates 11, 12, and 13, the grooves can be machined from the start end to the terminal end only on the portions where the grooves are to be formed without damaging the portions where the grooves are not to be formed while the water jet is being injected from the injection nozzle at the initial injection power. Thus, without the groove machining method by means of the etching, according to the groove machining method by means of water jet according to the present invention, it is possible to easily produce the grooved plate (heat exchanger member), which has the grooves (passages) as shown in FIG. 1, of the heat exchange core, which is a component of a heat exchanger. Moreover, as described above, it is possible to machine a deep groove whose aspect ratio is one or more, and which has an approximately uniform depth and a complex shape in a short period.

According to the groove machining method by means of water jet according to the present invention, in order to form multiple grooves along a travel direction of an injection nozzle at a small pitch, neighboring injection nozzles of multiple provided injection nozzles may be displaced forward and backward in the travel direction of the injection nozzles, and the water jet may be injected from these multiple injection nozzles. With this method, since the neighboring injection nozzles of the multiple provided injection nozzles are displaced forward and backward in the travel direction of the injection nozzles, it is possible to reduce the interval between the injection nozzles compared with the interval between the injection nozzles arranged on the same row, and, thus, to machine grooves at a smaller interval.

Moreover, with the water jet according to the present invention, in order to form terminal ends of the multiple grooves gradually displaced in an oblique direction with respect to the travel direction of the injection nozzles, a protection member may be disposed on the face to be machined, and, then, the terminal ends of the grooves may be formed, and, in order to form grooves starting from these terminal ends, a protection member may be disposed on the face to be machined so as to cover the previously machined multiple grooves, and, then, the injection nozzles may be moved in a direction which intersects the previously formed grooves to form start ends of these grooves.

If multiple curved grooves are formed by means of water jet, and the curved portion of the grooves are formed by means of continuous machining, the travel speeds are different between the inside and the outside of the curve on the grooves, and the depths at the inside and the outside are not the same. For example, if a thin plate (member to be machined) is grooved, a penetration may occur at the inside of the groove. Moreover, if a bent groove is formed, changing machining conditions such as decreasing the travel speed of an injection nozzle is necessary, and the depth of the groove is thus not constant. Moreover, if the travel and the injection of an injection nozzle are once stopped, and the travel direction is changed, it is difficult to maintain machining conditions, and, thus, it is difficult to keep the depth and the width of a groove constant. However, even if the multiple bent grooves are formed by means of water jet, by placing a protection member on a face to be machined so as to cover previously machined multiple grooves, moving the injection nozzles to a direction intersecting to the previously formed grooves, and forming start ends of the grooves, the depth and the width of the grooves can be approximately uniform.

EXAMPLE

Figure 8A:
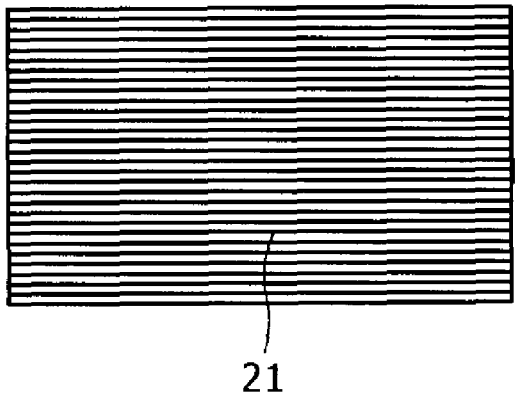
Figure 8B:
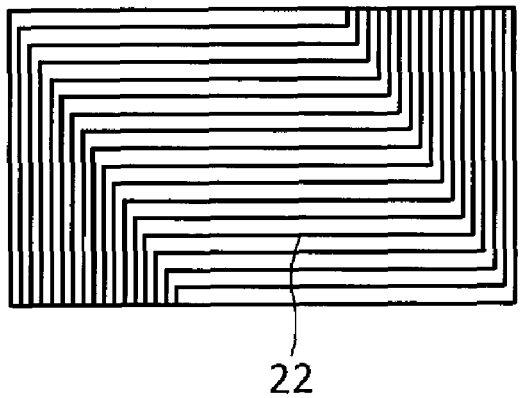
Figure 8C:
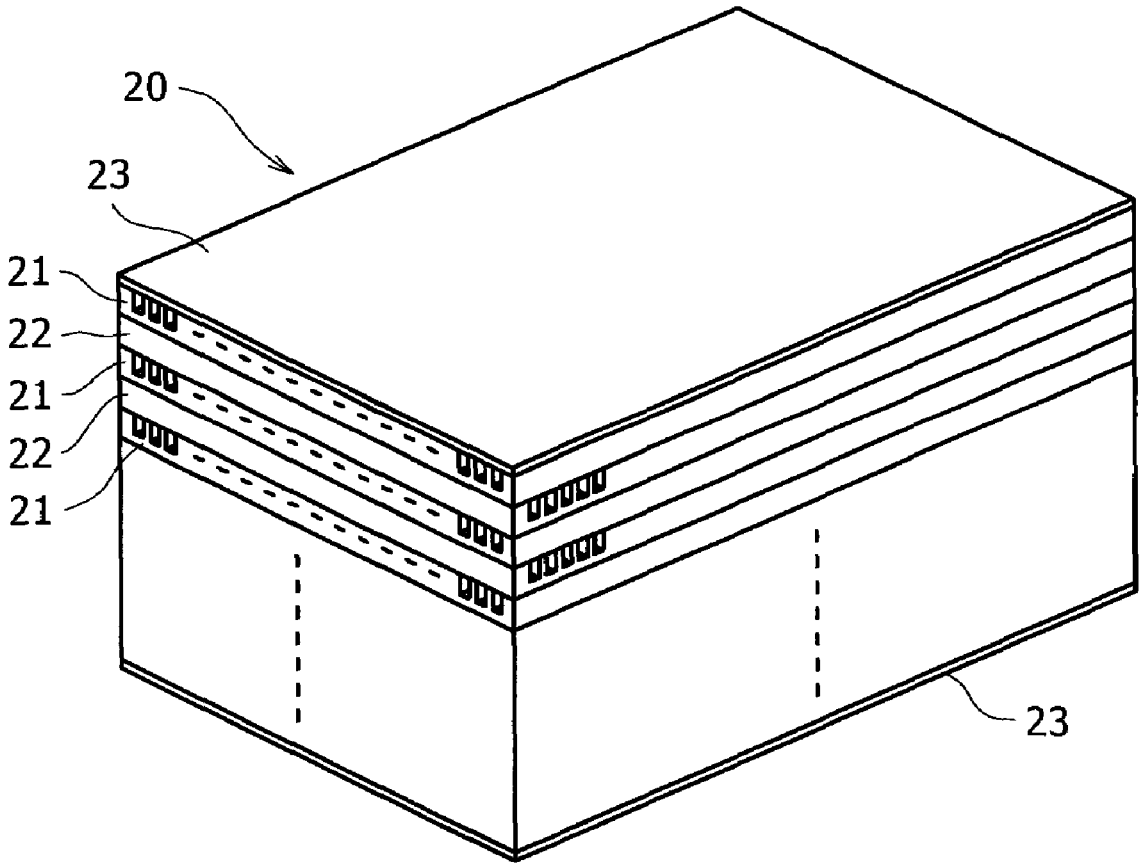

FIG. 8A shows a grooved plate for a heat exchanger produced by machining grooves by means of water jet without any protection members since the grooves have a form which does not require protection members. FIG. 8B shows a grooved plate for a heat exchanger produced by machining grooves by means of water jet with protection members (according to the groove machining method of the present invention). FIG. 8C shows a heat exchange core produced with these grooved plates. FIG. 8A shows a plate with straight grooves 21 on which straight grooves extending from one end to the other end are machined, and FIG. 8B shows a plate with bent grooves 22 on which bent grooves extending from one end to the other end are machined. The grooved plates 21, 22 for the heat exchange core are produced by forming passages including multiple grooves whose pitch is 1.6 mm, whose depth is 2 mm, whose width is 1 mm, and whose aspect ratio is 2 on one surface of a thin plate which is made of aluminum, and whose width and the length are respectively 200 mm and 400 mm under groove machining conditions that the pressure of the water jet device is 1500 kgf/cm$^2$, and the travel speed of the injection nozzle is 1000 mm/minute. It should be noted that it was confirmed that grooves whose depth is at least 1 mm can be machined with single path.

A heat exchange core 20 is constructed by alternately stacking the plates with straight grooves 21 and the plates with bent grooves 22, and stacking thin plates 23 at the top and the bottom in order to cover the openings of the grooves as shown in FIG. 8C. Though only one surface of each of the thin plates is grooved in this example as shown in FIGS. 8A and 8B, if the plates are thick, both the front and rear surfaces thereof may be grooved.

Since this heat exchange core has a large surface area per volume due to the grooves with the large aspect ratio formed on the grooved plates, if only one surface of the plates is grooved, it is possible to manufacture a heat exchanger of high heat transfer performance with a stacked body obtained by combining and brazing the surface on the grooved side of one heat exchange core to the surface on the non-grooved side of another heat exchange core. Moreover, if both the surfaces of the plates are grooved, it is possible to manufacture a heat exchanger of high heat transfer performance with a stacked body obtained by interposing a thin plate between the heat exchange cores, and brazing them.

Though the specific shapes and dimensions of the protection plates and the thin plate are described in the embodiment, they are simply examples. In other words, the specific shapes and dimensions of the protection plates and the thin plate can be properly set as necessary, and the description of the embodiment of the present invention is thus not intended to limit the application of the present invention. Moreover, though the description is given of an example where the thin plate, which is the member to be machined, is an aluminum plate, grooves can be machined on a plate made of stainless steel, copper, titanium, and the like according to the groove machining method of the present invention. Accordingly, material of the thin plate is thus not limited to aluminum, and may be a non-metal material such as ceramic. Further, the stacked body may be joined by a method other than brazing such as diffusion bonding and welding.

What is claimed is:

1. A groove machining method which machines a complex groove pattern of intersecting grooves on a face of a workpiece, the grooves having defined ends in the direction of the length of the grooves, using a water jet device including an injection nozzle for injecting a water jet on a face to be machined of a member to be machined, comprising:

a first disposing step of disposing a first protection member, which is more resistive against an injection power of the water jet than the member to be machined, at a first position so as to cover a portion of the face to be machined in a first groove machining step, and on which grooves are not to be formed in the first groove machining step;

a first moving step of moving the injection nozzle in a first direction across the protection member and the face to be machined while injecting the water jet at a predetermined injection power from the injection nozzle, to perform the first groove machining step in which first grooves are formed in the face to be machined, the first grooves having at least one end defined by the protection member at said first position;

a step of removing the first protection member from the member to be machined;

a second disposing step of disposing a second protection member which, is more resistive against an injection power of the water jet than the member to be machined, at a second position different from said first position so as to cover a portion of said face to be machined in a second groove machining step, and on which grooves are not to be formed in the second groove machining step, wherein the portion to be machined in the second groove machining step is different from the portion to be machined in the first groove machining step; and a second moving step of moving the injection nozzle in a second direction across the protection member and the face to be machined while injecting the water jet at a predetermined injection power from the injection nozzle, to perform the second machining step in which second grooves are formed in the face to be machined, the second grooves intersecting with the first grooves and each of the second grooves having at least one end defined by the protection member at said second position, wherein the second direction is different from the first direction.

2. The groove machining method by means of water jet according to claim 1, wherein the water jet is injected from a plurality of provided injection nozzles.

3. The groove machining method by means of water jet according to claim 1, wherein the member to be machined is made of metal, and abrasives are mixed with the water jet.

4. The groove machining method according to claim 3, wherein each of the first and second groove machining steps is performed such that the aspect ratio of the groove formed by any of the groove machining steps is equal to or more than 1.

5. The groove machining method according to claim 1, wherein the first and second groove machining steps are performed on one of front and rear faces of a plate-shape member.

6. The groove machining method according to claim 4, wherein the first and second groove machining steps are performed on both of front and rear faces of the plate-shape member.

* * * * *